United States Patent [19]

Fujita et al.

[11] Patent Number: 4,497,266

[45] Date of Patent: Feb. 5, 1985

[54] AUTOMATIC SEWING MACHINE AND CLOTH RETAINER THEREFOR

[75] Inventors: Jiro Fujita; Iwao Yamane, both of Aichi, Japan

[73] Assignee: Mitsubishi Denki Kabushiki Kaisha, Tokyo, Japan

[21] Appl. No.: 537,473

[22] Filed: Sep. 29, 1983

[30] Foreign Application Priority Data

Sep. 29, 1982 [JP] Japan ..... 57-170692

[51] Int. Cl.[3] ..... D05B 19/00

[52] U.S. Cl. ..... 112/121.11; 112/121.12

[58] Field of Search ..... 112/121.12, 121.11, 112/121.15, 65

[56] References Cited

U.S. PATENT DOCUMENTS

| | | | |
|---|---|---|---|
| 2,944,496 | 7/1960 | Garner | 112/121.11 |
| 3,443,533 | 5/1969 | Posey et al. | 112/121.11 |
| 3,653,347 | 4/1972 | Biachi | 112/121.12 |
| 3,822,658 | 7/1974 | Conner | 112/121.12 |

FOREIGN PATENT DOCUMENTS

| | | | |
|---|---|---|---|
| 2067308 | 7/1981 | United Kingdom | 112/121.12 |
| 2083846 | 3/1982 | United Kingdom | 112/121.11 |

*Primary Examiner*—Ronald Feldbaum

*Attorney, Agent, or Firm*—Sughrue, Mion, Zinn, Macpeak & Seas

[57] ABSTRACT

An automatic sewing machine includes a cloth retainer for holding a material to be sewn and which is driven by a cloth retainer driving device. The cloth retainer driving device includes a cloth retainer positioning and holding mechanism detachably positioning and holding the cloth retainer, and a driving mechanism driving the positioning and holding mechanism to automatically perform holding and release of the cloth retainer. The driving mechanism drives the positioning and holding mechanism in response to an instruction signal supplied from a control device prior to the start of sewing to automatically positioning and hold the cloth retainer, and automatically releases the positioning and holding of the cloth retainer upon the completion of sewing.

8 Claims, 6 Drawing Figures

AUTOMATIC SEWING MACHINE AND CLOTH RETAINER THEREFOR

BACKGROUND OF THE INVENTION

The present invention relates to an automatic sewing machine provided with a cloth retaining device, and more particularly, to a type of such a device wherein the cloth retaining device is driven according to programmed data, so that the cloth is automatically sewn.

An automatic sewing machine which has a cloth retaining device adapted to move a cloth retainer horizontally with respect to a sewing needle which reciprocates vertically is well known. Such a cloth retaining device is widely employed for industrial sewing machines.

A conventional cloth retaining device of this type is shown in FIG. 1. A cloth retainer 12 is provided for holding the material 10 to be sewed. The cloth retainer 12 is constructed as described below. That is, one end of a lower retaining plate 16 is fixedly secured to a retainer mounting plate 14 and one end of an upper retaining plate 18 is hingedly secured to the retainer mounting plate 14 by a hinge 20 in such a manner that there is a small gap between the two plates 16 and 18. Sewing holes 16*a* and 18*a* are formed in the retaining plates 16 and 18, respectively, according to desired sewing patterns. Thus, the desired sewing patterns are formed within a zone defined by the sewing holes 16*a* and 18*a*.

The cloth retaining device has a cloth retainer driving device 22 for driving the cloth retainer 12 to predetermined positions. The device 22 has a slider 24. Slider shafts 26 and 28 are slidably inserted into the slider 24 in a manner such that the slider shafts 26 and 28 extend in the directions of the X and Y axes, respectively. The slider 24 performs sliding movement in the direction of the shafts 26,, 28 driven by means of a pulse motor (not shown). A retainer mounting stand 30 is fixedly provided on the slider 24 to install the cloth retainer 12. Positioning and holding pins 32 and 34 upstand from the upper surface of the retainer mounting stand 30. Those pins 32 and 34 are engaged with two positioning and holding holes 14*a* and 14*b* formed in the retainer mounting plate 14 of the cloth retainer 12. The cloth retainer driving device 22 thus constructed is driven by a control device (not shown) according to programmed data stored therein.

The conventional automatic sewing machine cloth retaining device is constructed as described above. Its operation will now be described.

First, the material 10 to be sewn is positioned in place between the retaining plates 16 and 18 of the cloth retainer. Then, the positioning and holding holes 14*a* and 14*b* of the cloth retainer 12 are engaged with the positioning and holding pins 32 and 34 of the cloth retainer driving device 22, respectively, so that the cloth retainer 12 is positioned and held at a predetermined position on the device 22. When a operating pedal (not shown) is operated, sewing is started whereby a desired sewing pattern is formed on the material 10 according to programmed data.

Upon the completion of sewing, the sewing machine is automatically stopped. The operator releases the engagement between the pins 32, 34 and holes 14*a*, 14*b* to remove the cloth retainer 12 from the cloth retainer driving device 22, and opens the upper retaining plate 18 to take out the material 10. Thereafter, the next piece 10 to be sewn is set in place between the retaining plates 16 and 18 of the cloth retainer 12. Similarly as in the above-described case, the cloth retainer is positioned and held by manually engaging it with the driving device 22, and sewing is again started.

The conventional cloth retaining device of the automatic sewing machine is disadvantageous in that the sewing operation is complicated and the work efficiency is low because the cloth retainer 12 must be manually engaged with or disengaged from the driving device 22 as described above. Furthermore, in the conventional device, the cloth retainer 12 is positioned in place and held merely by engaging the positioning and holding pins 32 and 34 with the positioning and holding holes 14*a* and 14*b* as described above. Therefore, during sewing the cloth retainer 12 is liable to vibrate vertically; that is, it is difficult to positively position and hold the same. This is another drawback of the conventional device.

SUMMARY OF THE INVENTION

In view of the above-described difficulties accompanying the conventional cloth retaining device, an object of this invention is to provide an automatic sewing machine in which the cloth retainer is automatically and positively connected to and disconnected from the sewing machine body, whereby the work efficiency is improved.

The foregoing object of the invention has been achieved by the provision of a cloth retaining device for an automatic sewing machine which comprises a cloth retainer for holding a material to be sewn; a cloth retainer driving device for driving the cloth retainer; a cloth retainer positioning and holding mechanism provided in the cloth retainer driving device, for detachably positioning and holding the cloth retainer; a drive device for driving the cloth retainer positioning and holding mechanism; and a control device for controlling the drive device in accordance with stored programmed data. The cloth retainer set in place before a sewing operation starts is automatically positioned and held by the cloth retainer positioning and holding mechanism, and after the sewing operation is accomplished, positioning and holding of the cloth retainer is automatically released.

DETAILED DESCRIPTION OF THE PREFERRED EMBODIMENTS

Figure 1:
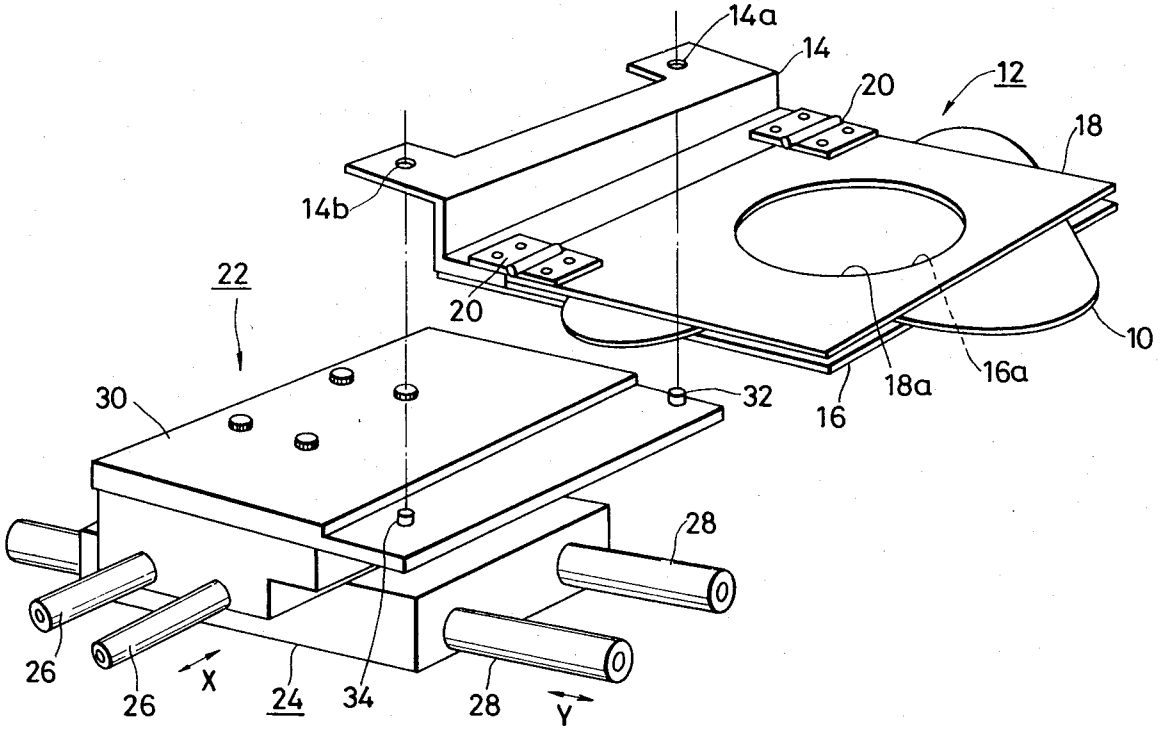
FIG. 1 (PRIOR ART)
FIG. 1 is an assembly diagram showing one example of a conventional cloth retaining device of an automatic sewing machine.
Figure 2:
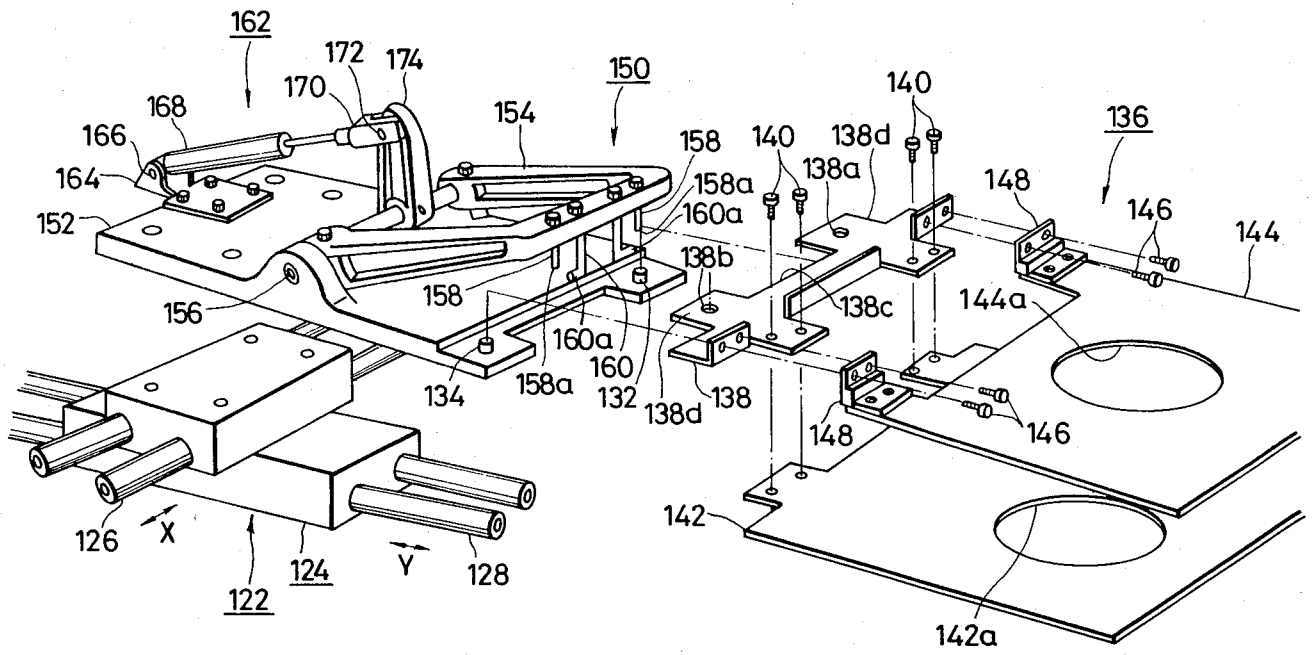
FIG. 2 is an assembly diagram showing one preferred embodiment of a cloth retaining device of an automatic sewing machine according to this invention.

FIG. 2 shows one embodiment of a cloth retaining device for an automatic sewing machine according to the invention.

In this example, the cloth retainer 136 for retaining a material 110 to be sewn is constructed as follows: A lower retaining plate 142 is fixedly secured to a retainer mounting plate 138 with screws 140, and an upper retaining plate 144 is pivotally secured, through hinges 148, to the retainer mounting plate 138 with screws 146 in a manner such that there is a small gap between the plates 142 and 144. Sewing holes 142*a* and 144*a* are formed in the plates 142 and 144, respectively, according to desired sewing patterns.

A cloth retainer driving device 122 is provided so as to detachably position and hold the cloth retainer 136 at a predetermined position. The device 122 mounts thereon a cloth retainer positioning and holding mechanism 150. That is, a retainer mounting stand 152 of the mechanism 150 is fixedly secured to a slider 124 of the driving device 122. The slider 124 performs sliding movement when driven by stepping motors 184, 185 with respect to slider shafts 126 and slider shafts 128 extending perpendicular to the shafts 126. These shafts extend along X-Y axes as shown in FIG. 2. Positioning and holding pins 132 and 134 which are engaged with positioning and holding holes 138*a* and 138*b* formed in the retainer mounting plate 138 of the cloth retainer 136 project from an end portion of the retainer mounting stand 152. A retaining arm 154 is pivotally mounted on a shaft 156 at the middle portion of the retainer mounting stand 152. Retaining rods 158 for retaining the retainer mounting plate 138 of the cloth retainer 136 in place, and lifting rods 160 for lifting the retainer mounting plate 138 are fixedly secured to a free end portion of the retaining arm 154. The retainer mounting stand 152 has a drive device 162 for swinging the retaining arm 154. The drive device 162 includes a tiltable air cylinder 168 which is pivotally mounted on a shaft 166 on a cylinder stand 164 secured to the stand 152. A lever 174 is rotatably mounted on a pin 172 at one end which is coupled to a knuckle 170 fixed to the end of the air cylinder 168. The other end of the lever 174 is fixedly secured to the aforementioned shaft 156. Thus, the retaining arm 154 is swung in response to extension and retraction of the cylinder shaft of the air cylinder 168.

Figure 5:
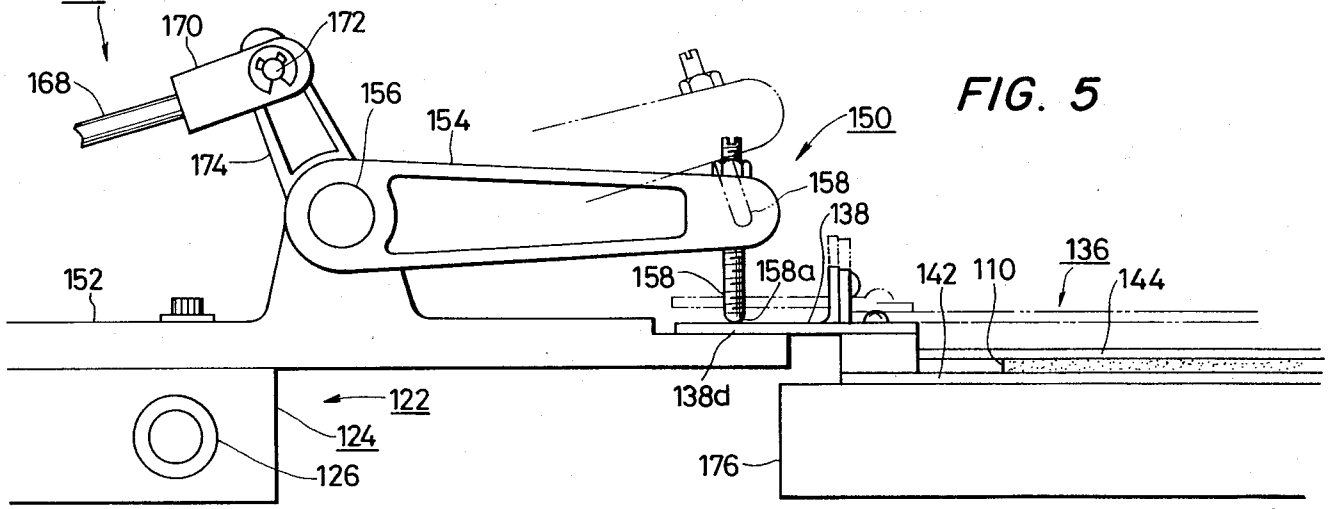

By the control governed by a control device 177 described later, the cloth retainer driving device 122 drives the cloth retainer 136 according to programmed data, and the drive device 162 mounts and demounts the cloth retainer 136 according to control instructions. When the cloth retainer 136 is driven, the lower surface of the lower retaining plate 142 slides on the upper surface of a top plate 176 (FIG. 5).

Figure 6:
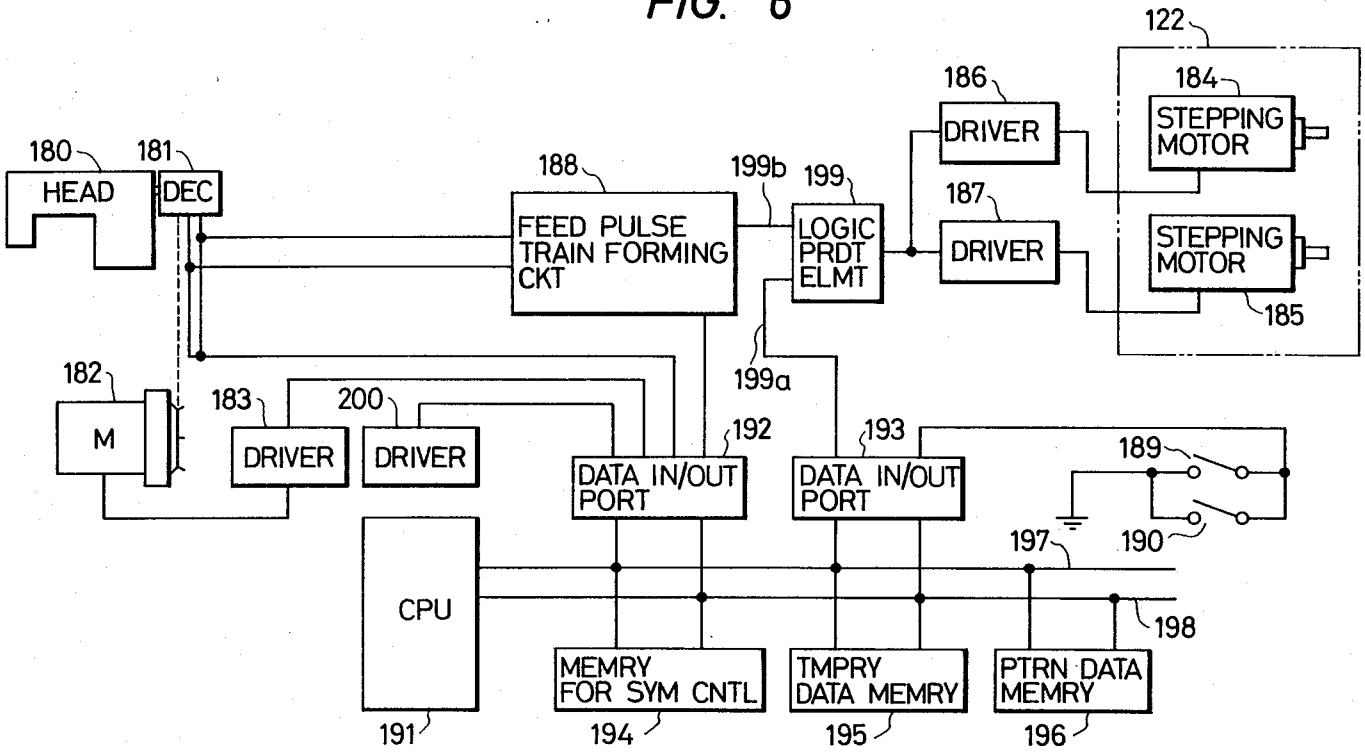
FIG. 6 is a block diagram showing the control device in detail.

The above-mentioned control device 177 is constructed as shown in FIG. 6. In FIG. 6, reference numeral 180 designates a sewing machine head. A detector 181 is provided on an upper shaft of the machine head 180, and is rotated together with the shaft. The detector generates a given numbers of pulses per rotation, and needle upper and lower position signals. The sewing machine is driven by a motor 182 operated by a driver 183. Reference numerals 184, 185 designate stepping motors secured to the cloth retainer driving device 122 to drive the retainer 112 along perpendicular directions X, Y. These stepping motors are driven by drivers 186, 187. Numeral 188 designates a feeding pulse train forming circuit adapted to supply the drivers 186, 187 with pulses equivalent to the ordered cloth feeding amount. Numeral 189 designates a sewing machine starting switch; 190, a switch for vertically moving the cloth retainer 136; 191, a CPU; 192 and 193, data input/output ports; 149, a memory for system control; 195, a temporary data memory; 196, a pattern data mamory; 197, a data-bus; 198, an address bus; 199, a logic product element which allows the pulse train to pass therethrough; 199*a*, 199*b*, input lines for the element 199; and 200, a driver for the air cylinder 168 of the driving device 162. The control device 177 is provided by the elements 183, 186–199, 199*a* and 199*b*.

The preferred embodiment of the invention is constructed as described above. Its operation will now be described.

First, the basic operation of the automatic sewing machine according to the present invention will be described.

Upon depression of the cloth retaining switch 190, the driver 200 is actuated so that the cloth retainer retains the cloth 110 to be sewn. Upon closing the sewing machine starting switch 189, CPU 191 drives the sewing machine motor driver 183 through the input/output ports 192, to energize the motor 182, to thus start the sewing operation. Concurrently, CPU 191 operates to read out cloth feeding data per one needle pitch, in synchronization with the needle lower position signal detected by the detector 181, from the memory 196, to which sewing pattern data are inputted. Then, the thus obtained cloth feeding data are applied to the feeding pulse train forming circuit 188 through the input/output ports 192.

The pulse train equivalent to the cloth feeding amount, in synchronization with the rotation of the sewing machine, is outputted to the input line 199*b* of the logic product element 199 from the feeding pulse train forming circuit 188, by synchronization with the pulses from the detector 181. In this instance, a high level output is applied to the input line 199*a* of the logic product element 199 from the input/output ports 193, and the pulse train is applied to the stepping motor drivers 186, 187, to thereby drive the stepping motors 184, 185 provided respectively on the shafts 126, 128, to thus move the cloth retainer 136 by a predetermined feeding amount. A sewing pattern is thus provided by these sequential operations.

Figure 3:
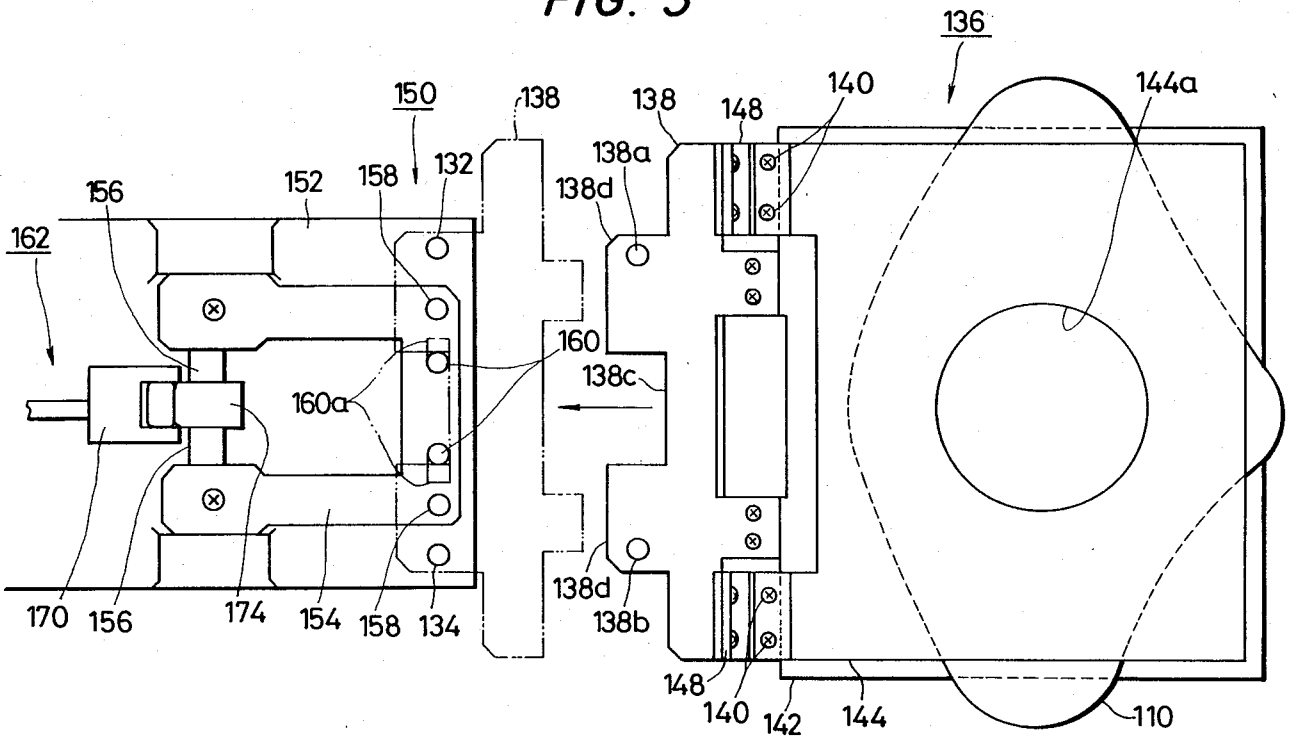
FIG. 3 is an explanatory diagram describing a method of setting the cloth retainer in the device shown in FIG. 2.
Figure 4:
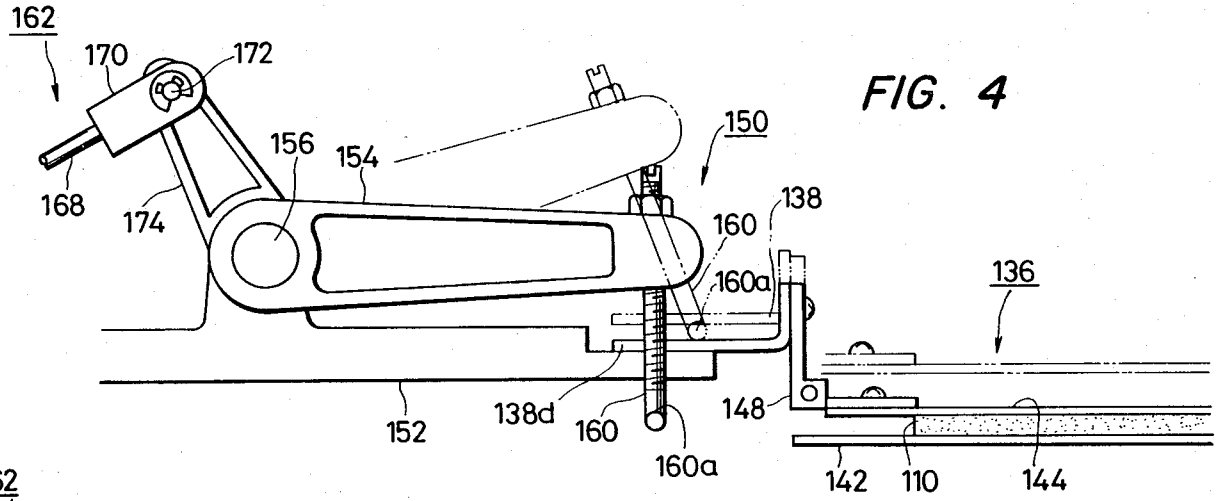
FIGS. 4 and 5 are explanatory diagrams describing the operation of positioning and holding the cloth retainer in the device of FIG. 2.

Before starting sewing, the operator carries out the following preliminary operation: The material 110 to be sewn is held in place between the two retaining plates 142 and 144 of the cloth retainer 136. Then, as shown in FIG. 3, the cloth retainer 136 is set so that the lifting rods 160 are located in a cut 138*c* formed in the retainer mounting plate 138, and protrusions 138*d* of the retainer mounting plate 138, which are provided by forming the cut 138*c*, are inserted between the end portions 158*a* of the retaining rods 158 and the hooking portions 160*a* of the lifting rods 160, respectively. In this operation, as indicated by the phantom lines in FIGS. 4 and 5, the retaining arm 154 is raised by the air cylinder 168, and accordingly the lower surfaces of the protrusions 138*a* of the retainer mounting plate 138 are abutted against the hooking portions 160*a* of the lifting rods 160.

When the operator operates the cloth retaining switch 190, the control device 177 outputs a control instruction, that is, by the instruction of the driver 200, to drive the air cylinder 168. As a result, the retaining arm 154 is swung in the clockwise direction in FIG. 4 or 5, and the cloth retainer 136 set between the retaining rods 158 and the lifting rods 160 is lowered. Accordingly, the pins 132 and 134 projected from the retainer mounting stand 152 are brought into engagement with the holes 138*a* and 138*b* formed in the retainer mounting plate 138, and the protrusions 138*d* of the retainer mounting plate 138 are pushed downwardly by the retaining rods 158, so that the cloth retainer 136 is automatically positioned and held in place.

Upon the operation of a start switch 189, sewing is started. In response to a control instruction from the control device 177, the cloth retainer 136 is driven by the stepping motors 184, 185 according to programmed data stored in the memory 196, so that a desired sewing pattern is formed on the material 110. During the sewing operation, the cloth retainer 136, being positively positioned and held by the cloth retainer positioning and holding mechanism 150, will never play, and may slide smoothly on the upper surface of the top plate 176.

Upon the completion of the sewing operation, the sewing thread is automatically cut by a conventional thread cutting device and the operation of the sewing head 180 is stopped. Immediately after the sewing head has stopped, the driver 200 of the control device 177 outputs a control instruction to drive the air cylinder 168, so that the retaining arm 154 is swung in the counterclockwise direction in FIGS. 4 and 5. In this operation, the protrusions 138*d* of the retainer mounting plate 138 are lifted by the hooking portions 160*a* of the lifting rods 160 while the positioning and holding holes 138*a* and 138*b* of the retainer mounting plate 138 are disengaged from the positioning and holding pins 132 and 134, so that the positioning and holding state of the cloth retainer 136 is automatically released.

As is clear from the above description, according to the invention, the cloth retainer is automatically mounted to or uncoupled from the sewing machine body, which improves the work efficiency of the sewing machine.

Furthermore, according to the invention, the cloth retainer is positively positioned and held. Therefore, during sewing, the cloth retainer will never be subject to play, and can thus be stably driven.

What is claimed is:

1. A cloth retaining device for an automatic sewing machine, comprising;

(a) a cloth retainer for holding a material to be sewn;

(b) a cloth retainer driving device for driving said cloth retainer while positioning and holding the same at a predetermined position; and (c) a control device for supplying a driving signal to said cloth retainer driving device in accordance with programmed data, said driving device including a cloth retainer positioning and holding mechanism adapted to detachably position and hold said cloth retainer, and a drive mechanism adapted to position and hold said cloth retainer and to release the positioning and holding thereof in response to instruction signals supplied from said control device prior to the start of a sewing operation and after completion of the sewing operation, respectively.

2. A device as claimed in claim 1, wherein said cloth retainer comprises a lower retaining plate on which said material is mounted, and an upper retaining plate confronting said lower retaining plate with a space therebetween for the insertion of said material.

3. A device as claimed in claim 2, wherein said lower retaining plate is detachably secured to said cloth retainer positioning and holding mechanism, and said upper retaining plate is detachably and hingedly secured to said positioning and holding mechanism.

4. A device as claimed in claim 1, wherein said cloth retainer driving device comprises a slider mechanism driven along perpendicularly extending shafts, and slider drive means driven in response to driving signals from said control device.

5. A device as claimed in claim 4, wherein said slider drive means comprises a first motor for moving said slider mechanism in a first direction, and a second motor for moving the slider mechanism in a second direction perpendicular to said first direction.

6. A device as claimed in claim 4, wherein said cloth retainer positioning and holding mechanism and said drive mechanism are mounted on said slider mechanism.

7. A device as claimed in claim 1, wherein said drive mechanism comprises pneumatic means controlled by said control device, and a lever connected between said pneumatic means and said cloth retainer positioning and holding mechanism.

8. A device as claimed in claim 1, wherein said control device comprises a feeding pulse forming circuit adapted to receive signals synchronized with needle position signals, and a central processing unit operating to read out cloth feeding data, in synchronization with said needle position signals, from a memory in which sewing pattern data are stored, said pulse forming circuit outputting pulses equivalent to a cloth feeding amount, in synchronization with machine rotation, to said cloth retainer driving device.

* * * * *